US007007619B2

(12) United States Patent
Hamajima

(10) Patent No.: US 7,007,619 B2
(45) Date of Patent: Mar. 7, 2006

(54) FOOT CONTROLLER CONNECTION ERROR DETECTION DEVICE FOR SEWING MACHINES

(75) Inventor: Eiichi Hamajima, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/187,006

(22) Filed: Jul. 22, 2005

(65) Prior Publication Data

US 2006/0021555 A1 Feb. 2, 2006

(30) Foreign Application Priority Data

Jul. 28, 2004 (JP) ..... 2004-219918

(51) Int. Cl.
*D05B 69/18* (2006.01)

(52) U.S. Cl. ..... 112/470.01; 112/217.4; 200/86.5; 318/551

(58) Field of Classification Search ..... 112/470.01, 112/217.4, 220, 275, 277; 200/86.5; 318/551; 338/153; 388/840
See application file for complete search history.

(56) References Cited

U.S. PATENT DOCUMENTS 4,299,182 A * 11/1981 Tanaka ..... 112/277
4,393,796 A * 7/1983 Dunn et al. ..... 112/445

FOREIGN PATENT DOCUMENTS

JP A 55-71186 5/1980

* cited by examiner

*Primary Examiner*—Peter Nerbun
(74) *Attorney, Agent, or Firm*—Oliff & Berridge, PLC

(57) ABSTRACT

A foot controller connection error detection device of the present invention includes a foot controller to output a start/stop instruction and a rotation speed instruction of a sewing machine motor to a control unit to control the sewing machine motor, a plug to disconnectably connect the foot controller to the control unit and a contact failure detection unit to detect a contact failure of the connector between the plug and the control unit.

12 Claims, 8 Drawing Sheets

FOOT CONTROLLER CONNECTION ERROR DETECTION DEVICE FOR SEWING MACHINES

CROSS-REFERENCE TO RELATED APPLICATIONS

This application is based upon and claims the benefit of priority from the prior Japanese Patent Application No. 2004-219918, filed on Jul. 28, 2004 the entire contents of which are incorporated herein by reference.

BACKGROUND OF THE INVENTION

1. Field of the Invention

The present invention relates to a foot controller connecting to a sewing machine and more particularly to a foot controller connection error detection device to detect a contact failure between a plug provided on the foot controller and a jack provided on the sewing machine.

2. Description of the Related Art

Conventional types of embroidery machines or lock stitch sewing machines are provided with a needle bar drive mechanism provided in an arm of a sewing machine to vertically move the needle bar with a sewing needle attached and a loop taker and a speed adjustment dial to enable the setting of sewing speed. When the user operates a start/stop switch, the needle bar drive mechanism and the loop taker is driven via a sewing machine main shaft in a synchronized manner by a sewing machine motor. Therefore, utility patterns and embroidery patterns can be sewn on a fabric placed on a bed in a prescribed sewing speed.

The foot controller enables the user to give instructions to start a sewing process or adjust sewing speed even when the user's hands are occupied to hold the work fabric. A plug is provided on the end of a cord, extending from the body of the foot controller and the plug is connected to a jack provided in the body of the sewing machine. The user, by operating the foot controller with a depression of the foot can instruct the start of a sewing process and moreover change the sewing speed by the amount of depression.

For example, a safety device described in JP-A-1980-71186 is provided with a sewing machine motor, a speed controlling means to drive control the sewing machine motor and a speed instructing means etc. to provide speed instructing signals to the speed controlling means. When the user depresses the pedal provided on the speed instructing means, a resistance value of a variable resistor provided inside the speed instructing means is changed. When a speed instructing voltage corresponding to the resistance value is applied to the speed controlling means, the drive of the sewing machine motor is controlled in correspondence with the voltage (for example, refer to FIG. 1 and pages 6 to 7 of JP-A-1980-71186.).

That is, as shown in FIG. 8, a plug 111 is arranged on the end of a cord 120 connected to a foot controller 100 which serves as a speed controlling means. A first power line L1 and a first earth line L2 are arranged inside the cord 120, one end of which extends into the foot controller 100. Inside the foot controller 100, in between the first power line L1 and the first earth line L2, a resistance R3 (approximately 1 KΩ) and a variable resistor VR (maximum resistance value: approximately 10 KΩ) are connected in series. Also, the other end of the first power line L1 and the second earth line L2 are connected to the plug 111 respectively.

On the other hand, a second power line L3 and a second earth line L4 are arranged inside an electronic sewing machine M, both having one end connected to the jack 109 respectively. Also, the other end of the second power line L3 is connected to an analog signal input port AP of a microcomputer 16 mounted on a control base plate 115. On the second power line L3, a +5V of power voltage is applied via a pull-up resistance R1 (approximately 4.7 KΩ). The other end of the second earth line L4 is earthed.

The above described plug 111 is disconnect-ably connected to the jack 109, and on the microcomputer 116, the speed instructing voltage corresponding to the resistance value of the variable resistor VR is applied via the plug 111 and the jack 109.

In such configuration, since the foot controller 100 is not depressed at the point when the power is supplied into the electronic sewing machine M, the potential on a voltage dividing point P of the pull-up resistance R1, resistance R3 and variable resistor VR are small, hence a sewing machine motor 118 is not driven. However, when the user depresses the foot controller 100, the potential of the voltage dividing point P is changed corresponding to the amount of depression. The size of the drive voltage of the sewing machine motor 118 outputted from a drive circuit 117 also changes corresponding to the size of the potential. Therefore, the drive speed of the sewing machine motor 118 can be controlled in correspondence with the amount of depression of the foot controller 100. In this case, when a contact resistance Ra is generated between the first power line L1 and the second power line L3 and a contact resistance Rb is generated in between the first earth line L2 and the second earth line L4 due to time elapse, the contact state of a connector of the plug 111 and the jack 109 is impaired. Because the potential of the voltage dividing point P is increased by the sum of the two contact resistances Ra and Rb, a problem arises, in which the rotation speed of the sewing machine motor 118 exceeds the speed intended by the user.

Also, in case for example the plug 111 is not sufficiently inserted into the jack 109 and the contact of the plug 111 and the jack 109 is unstable, the total contact resistance value is rapidly increased or reduced. This leads to instability of the rotation speed of the sewing machine motor 118, thereby giving rise to the so called speed disparity problem.

SUMMARY OF THE INVENTION

It is an object of the present invention to provide a foot controller connection error detection device for a sewing machine, which is capable of reliably detecting contact failures in the connector of the foot controller of the sewing machine.

According to one aspect of the present invention, a foot controller connection error detection device of a sewing machine of the present invention is provided with a foot controller to output a start/stop instruction and a rotation speed instruction of a sewing machine motor to a control unit which controls the sewing machine motor; a plug to disconnect-ably connect the foot controller to the control unit; and a contact failure detection unit to detect contact failures between the connector of the plug and the control unit.

The above described configuration provides reliable detection of contact failures in the connector of the plug and the control unit and reliably prevents the occurrence of speed disparity during the sewing process.

According to another aspect of the present invention, a foot controller contact failure detection device of a sewing machine in the present invention is provided with a foot controller to output start/stop instructions and rotation speed instructions to a microcomputer which controls a sewing machine motor; a plug to disconnect-ably connect the foot controller to a control unit having a microcomputer; and a variable resistor connected in between a power line and an earth line inside the foot controller, in which a resistance value changes in correspondence with the amount of depression of the foot controller. The foot controller contact failure detection device is further provided with a diode connected in between the power line and the earth line in a reverse direction to the power applying direction. The diode is connected in parallel with the variable resistor and a constant voltage applier which applies constant voltage to the earth line via a resistance having a resistance value smaller than the resistance value of the electricity paths including the variable resistor. The microcomputer is arranged so that a scale of potential between the power line and the earth line can be set and the contact failures in the connector between the plug and the control unit is detected based on the voltage of the earth line set such that the voltage applied by the constant voltage applier becomes a forward voltage to the diode.

Given the above configuration, when the microcomputer sets the potential of the power line low, and the earth line high, in order to make the constant voltage applied to the diode by the constant voltage applier to become a forward voltage, the electricity paths including the variable resistor during a normal operation of the sewing machine is bypassed via the diode. That is, the voltage of the earth line in such case reflects the amount of resistance value incurred by other electricity paths including the connector of the plug and the control unit, without being affected by the resistance value incurred by the variable resistor.

Therefore, the contact failures in the connector can be reliably detected in correspondence with the increase of the contact resistance of the connector.

According to another aspect of the present invention, a foot controller connection error detection device of a sewing machine of the present invention is provided with a foot controller to output a start/stop instruction and rotation speed instruction to a control unit to control a sewing machine motor; a plug to disconnect-ably connect the foot controller to the control unit having a microcomputer and a variable resistor connected in between a power line and an earth line inside the foot controller, in which the resistance value changes in correspondence with the amount of depression of the foot controller. The foot controller connection error detection device is further provided with a Zenner diode which is connected in between the power line and the earth line in a reverse direction to the power applying direction and which is connected in parallel with the variable resistor.

The power line is connected to a first output port and a second output port of a microcomputer. The microcomputer switches between a normal operation mode to apply a constant voltage to the power line from the first output port via a first resistance having a predetermined resistance value and a connection error detection mode to apply constant voltage to the power line from the second output port via a second resistance having a smaller resistance value than the resistance value of the electricity paths including the variable resistor. The connection error detection mode detects contact failures in the connector of the plug based on the voltage of a connection point of the second resistance and the power line.

That is, in the normal operation mode, the microcomputer applies constant voltage to the first power line via the first output port and the first resistance, in which case, the resistance value of the first resistance and the variable resistor is set such that a Cascade voltage of the Zenner diode becomes less than the Zenner voltage. In the connection error detection mode, the microcomputer applies constant voltage to the power line via the second output port and the second resistance, in which case, the resistance value of the second resistance is set such that the Cascade voltage of the Zenner diode equals the Zenner voltage.

Then, in the connection error detection mode, the electricity path including the variable resistor in normal operation mode is bypassed by the operation of the Zenner diode. The voltage of the earth line in such case reflects the amount of resistance value incurred by other electricity paths including the connector of the plug and the control unit, without being affected by the resistance value incurred by the variable resistor. Therefore, the contact failure of the connector can be reliably detected in correspondence with the increase of the contact resistance of the connector.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Embodiments of the present invention are described hereinafter with reference to the drawings.

The first embodiment of the present invention is described hereinafter.

Figure 1:
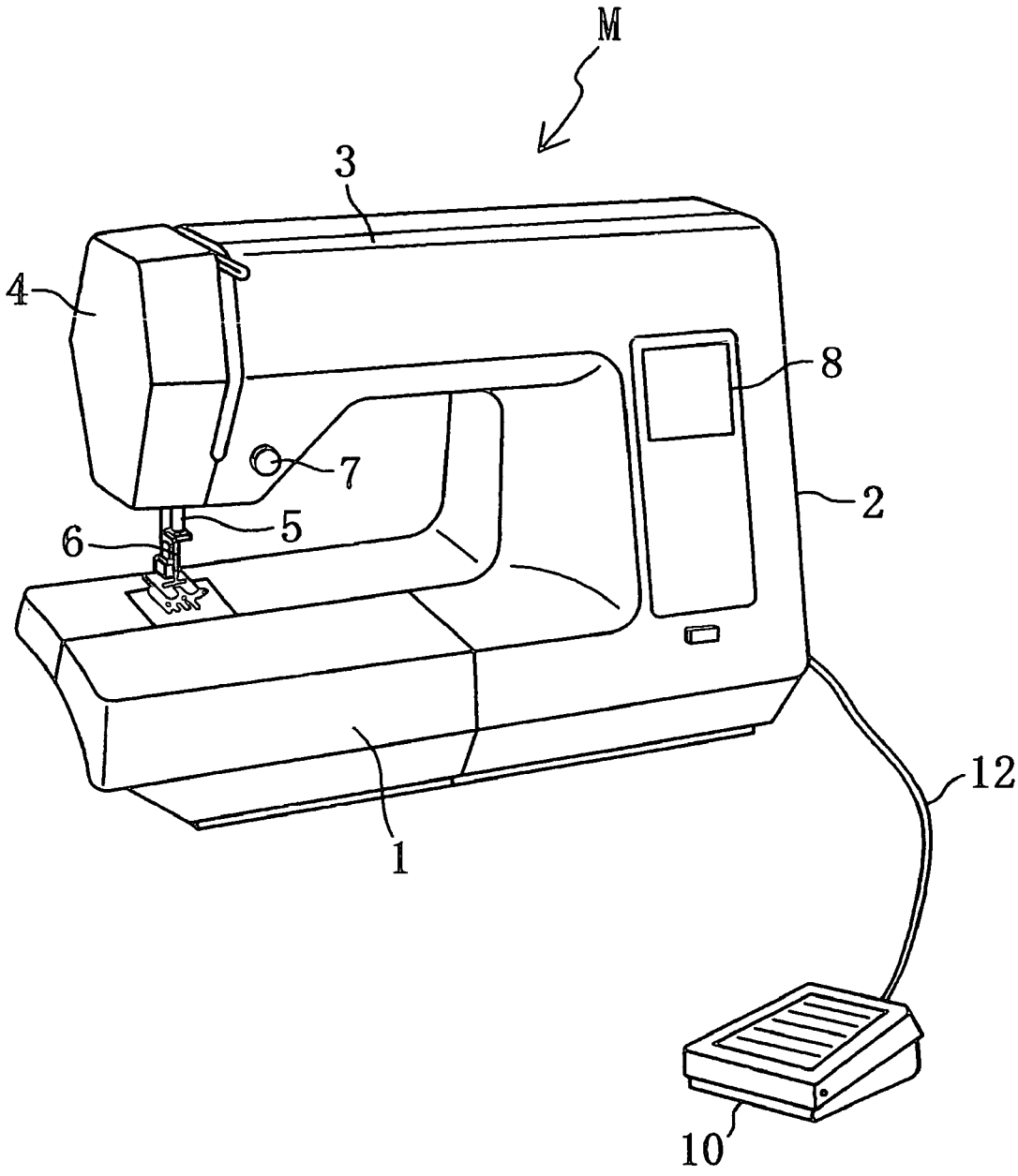
FIG. 1 is a perspective view of an electronic sewing machine in accordance with the first embodiment of the present invention.

First, a brief description of the configuration of an electronic sewing machine M capable of sewing various utility patterns are given. As shown in FIG. 1, the electronic sewing machine M is provided with a bed 1, a pillar 2 standing on the right end of the bed 1, an arm 3 extending leftward over the bed 1 from the upper end of the pillar 2. On the bed 1, a feed dog vertically moving mechanism to vertically move the feed dog; a feed dog longitudinally moving mechanism to longitudinally move the feed dog; a loop taker (for example a horizontal shuttle) which accommodates a lower thread bobbin and which is driven in synchronization with a sewing needle; and a thread trimmer mechanism, neither of which are shown, are provided.

On the arm 3, a needle bar driving mechanism to vertically move a sewing needle 6 attached to the lower end of the needle bar 5, a needle bar swinging mechanism to swing the needle bar 5 in a direction perpendicular to the fabric feeding direction and a thread take-up drive mechanism to vertically move a thread take-up in synchronization with the vertical movement of the needle bar etc., neither of which are shown, are provided. The feed dog vertically moving mechanism, feed dog longitudinally moving mechanism and a needle bar vertically moving mechanism are driven by a sewing machine motor 18 via a sewing machine main shaft and the needle bar swinging mechanism is driven independently by a needle swinging stepping motor.

In a head 4 of the arm 3, a start/stop switch to instruct a start and stop of the sewing work is provided. On the front side of the arm 3, a color liquid crystal display 8 (hereinafter simply referred as a display 8) is provided and on the display 8, various stitching patterns referred as utility patterns, various function names, and furthermore, various messages are displayed.

On the front side of this display 8, a plurality of touch keys configured by transparent poles are provided in a matrix form to represent various utility patterns, the names of such utility patterns and the names of each function required to perform the sewing work. Therefore, the user can select the desired utility pattern and function by pressing the touch key corresponding to the utility pattern and function name.

On the right side of the pillar 2, a jack 9 to connect a plug 11 for a foot controller 10 is provided. The plug 11 is provided on the end of a cord 12 extending from the main body of the foot controller 10 and is disconnectably connected to the jack 9. Therefore, by depressing the foot controller 10, the user can instruct a sew start without operating the start/stop switch 7 or sewing speed adjustment dial and moreover can change the sewing speed by the amount of depression.

Next, sewing machine motor speed control circuit and contact failure detection circuit are described with reference to FIG. 2. However, the motor, the display, and the switches etc. not directly relevant to the sewing machine motor speed control circuit are not described in detail.

A microcomputer (contact failure detection unit) 16 is mounted on the control base plate (control unit) 15. On this microcomputer 16, a CPU 16*a*, a ROM16*b*, a RAM16*c*, an analog/digital converter (A/D) 16*d*, an analog signal input port AP1, AP2, output port OP1, OP2 and OP3 are provided. The analog signal input port AP1 corresponds to "the first analog signal input port", the analog signal input port AP2 to "the second analog signal input port", the output port OP1 to "the first output port" and the output port OP2 to "the second output port".

Inside the foot controller 10, the resistance R3 (approximately 1 KΩ) and variable resistor VR (maximum resistance value: approximately 10 KΩ) are connected in series in between a first power line L1 and a first earth line L2. Furthermore, a diode (contact failure detection unit) 13 is connected in between the first power line L1 and the first earth line L2 in the opposite direction of the power applying direction of the normal operation mode and connected in parallel to the variable resistor VR. The resistance value of the variable resistor VR changes in the range of approximately 0 to 10 KΩ depending upon the amount of depression of the foot controller 10 by the user.

The second power line L3 is connected to the output port OP1 and the analog signal input port AP1. Also, a +5 V of power voltage is applied to the earth line L4 from a power circuit (consistent applier) not shown via a pull-up resistance R2 (approximately 200 Ω which corresponds to the "resistor having a small resistance value").

A drive circuit 17 is connected to the output port OP3 and drives the sewing machine motor 18 based on the speed instructing voltage given by the microcomputer 16.

Next, a contact failure detection control and a motor drive control executed by the foot controller 10 is described with reference to FIG. 3. The contact failure detection control and motor drive control are started when a start/stop instruction switch (not shown) provided in the foot controller 10 is turned ON (start instruction) when the foot controller is depressed at the time of starting the sewing process.

When the foot controller 10 is depressed by the user, the microcomputer 16 sets the connection error detection mode (S10) to detect the contact failure between in the connector of the plug 11 and the jack 9. In the connection error detection mode, the microcomputer 16 outputs an "L" level (0 V) to the output port OP1 and switches the output status of output port OP2 to a Hi impedance (S11). The microcomputer 16 loads the data of the voltage generated in a voltage dividing point Q via the analog signal input port AP2.

Now, a concrete description will be given on the voltage generated on the voltage dividing point Q. In the connection error detection mode, since the potential of the first power line is set low (0 V) and the first earth line potential is set high (+5 V), a diode 13 is conducted with a forward biased voltage applied. Therefore, the resistance R3 and variable resistor VR is bypassed via the diode 13, in which case the voltage dividing point Q is not affected by the resistance value of the resistance R3 and the variable resistor VR. Hence, a voltage E can be arrived by the following formula, wherein Ra refers to the contact resistance generated in between the first power line L1 and the second power line L3, Rb refers to the contact resistance generated in between the first earth line L2 and the second earth line L4, and 0.6V refers to the forward voltage Vf generated in diode 13 when the diode 13 becomes a forward bias.

$$E=(5V-0.6V)\times\{(Ra+Rb)/(R2+Ra+Rb)\}+0.6V$$

According to this formula, for example, in case the contact state of the connector in between the plug 11 and jack 9 is good and the contact resistance Ra and Rb are small enough to be ignored, the voltage E nearly equals the forward voltage Vf of the diode 13 which is approximately 0.6 V. On the other hand, in case the contact of the connector in between the plug 11 and jack 9 is poor and the contact resistance Ra and Rb are 100 Ω respectively, the voltage E amounts to approximately 2.8 V, marginally exceeding the forward voltage Vf of the diode 13. To summarize, a threshold voltage is set based on the forward voltage Vf of the diode 13 and by comparing the threshold voltage and the voltage E, the connection state of the connector of the plug 11 and the jack 9 can be judged. In the present embodiment, the threshold voltage is set to 1 V.

The microcomputer 16 compares the voltage data (voltage E) of a voltage dividing point Q and the threshold voltage (1 V) (S13) and if the voltage of the voltage dividing point Q is less than 1V, that is, if it is judged that the contact of the connector in between the plug 11 and jack 9 is good with nearly no contact resistance (S13: No), the normal operation mode is set (S14). In the normal operation mode, the microcomputer 16 converts the output state of the output port OP1 to Hi impedance and outputs an "L" level (0 V) to the output port OP2 (S15). The microcomputer 16 loads the voltage data of a voltage dividing point P via the analog signal input port AP1 (S16). At this point, a reverse voltage is applied to the diode 13; therefore, the voltage of the voltage dividing point P equals the resistance value of the variable resistor VR, that is, the voltage corresponding to the amount of depression of the foot controller by the user. The microcomputer 16 controls the drive of the sewing machine motor 18 in correspondence with the voltage data of a voltage dividing point P (S 17). That is, the rotation speed of the sewing machine motor 18 is controlled based on the depression amount of the foot controller 10. After that, the microcomputer 16 repeats the process S15 to S17 until the sewing process is finished, that is until the depression of the foot controller 10 is released.

On the other hand, in the above described S13, when the microcomputer 16 judges that the voltage (voltage E) of the voltage dividing point Q is 1 V or more (S13: Yes), an error process is started(S18). In the error process, for example, a warning message indicating that a contact failure has occurred is displayed to the display and an alarm is set off.

Next, the interruption control is described with reference to FIG. 4. Even while the above described sewing process is being executed, an interval interruption is made to the microcomputer 16 in predetermined intervals. The microcomputer 16 executes the interruption control described in FIG. 4 every time the interval interruption is made. In S10A to S14A and S18A of FIG. 4, the processes same as S10 to S14 and S18 shown in FIG. 3 are executed. That is, when the interval interruption is made during the execution of the sewing process, the microcomputer 16 sets the connection error detection mode (S10A) and judges the contact state of the connector of the plug 11 and the jack 9 (S11A to S13A). In case contact failure is not detected (S13A: No), the normal operation mode is set (S14A) and the control returns to the sewing process. On the other hand, in case the contact failure is detected (S13A: Yes), the error process is executed (S18A).

As described above, according to the present invention, the microcomputer 16 in connection error detection mode is arranged to set the potential of the first power line L1 and the second power line L3 low and the potential of the first earth line L2 and the second earth line L4 high, in order to set the voltage applied by the +5 V voltage power supply via the resistance R2 to become a forward voltage against the diode 13, and to detect the voltage (voltage E) of the voltage dividing point Q of the second earth line L4 in such case. Therefore, in correspondence with the increase of the contact resistance Ra and Rb of the connector of the plug 11 and jack 9, the contacting error of the connector can be reliably detected. Also, the above given configuration can be realized with a simple circuit configuration.

Also, because the microcomputer 16 compares the voltage (voltage E) of the voltage dividing point Q with the threshold voltage set based on the forward voltage Vf of the diode 13 to judge the contact failure state of the connector, the criteria of judging whether contact failure has occurred or not is clarified to facilitate and moreover increase the precision of the judgment.

Also, because the microcomputer 16 switches between the connection error detection mode and normal operation mode, the contact failure can be judged reliably when in connection error detection mode, and reliably control the drive of the sewing machine motor 18 when in normal operation mode. Furthermore, because the switch between the connection error detection and normal operation mode is made in predetermined intervals, the contact failure can be detected immediately even when the contact failure occurs during the sewing process.

A second embodiment of the present invention will be described hereinafter with reference to FIGS. 5 to 7. The second embodiment is a partial variation of the sewing machine motor speed control circuit and contact failure detection circuit of the first embodiment, therefore, items and features that are common to the first embodiment will not be described.

Figure 5:
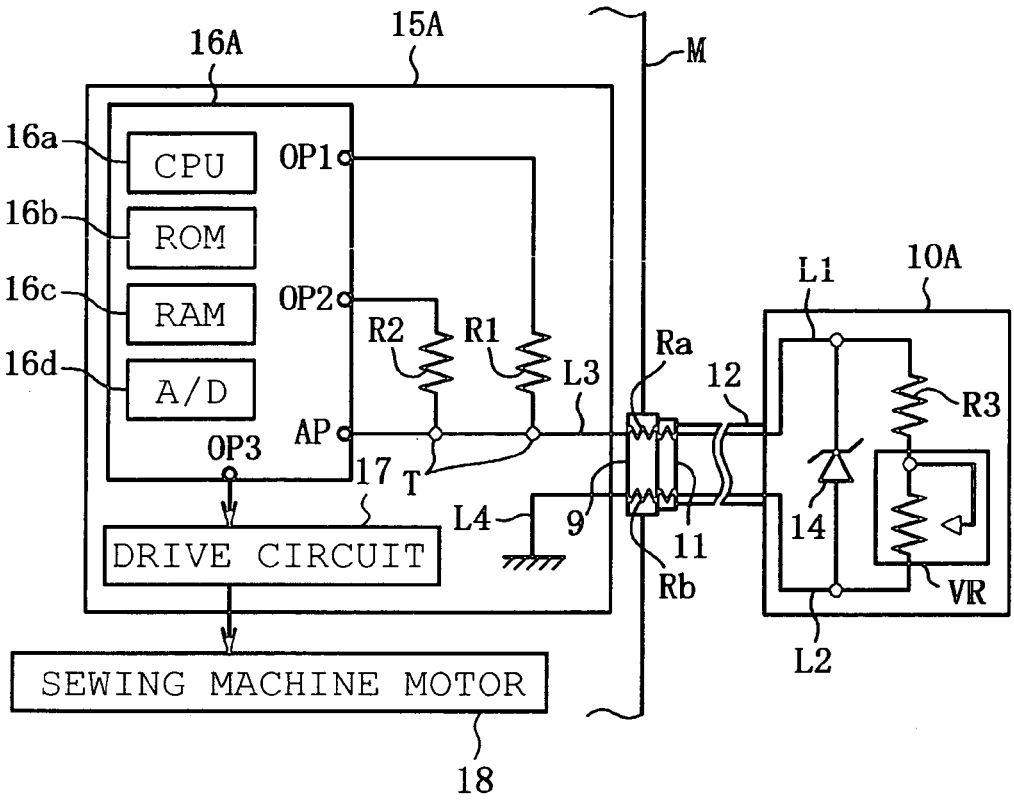
FIG. 5 corresponds to FIG. 2 concerning the second embodiment.

As shown in FIG. 5, a microcomputer (contact failure detection unit) 16A, is mounted in a control base plate (control unit) 15A. This microcomputer 16A is provided with an analog signal input port AP and output port OP1, OP2 and OP3. The output port OP1 corresponds to "the first output port" and output port OP2 to "the second output port".

Also, inside a foot controller 10A, a Zener diode 14 (Zenner current=approximately 3.9 V, contact failure detection unit), which is a constant voltage device, is connected in between the first power line L1 and the first earth line L2 in the reverse direction to the power applying direction in the normal operation. The Zener diode is connected in parallel to the variable resistor VR.

The second power line L3 is connected to the analog signal input port AP. Furthermore, the second power line L3 is connected to the output port OP1 via the resistance R1 (approximately 4.7 KΩ) as well as being connected to the output port OP2 via the resistance R2 (approximately 200 Ω). The resistance R1 corresponds to "the first resistance" and the resistance R2 to "the second resistance".

Next, a foot controller contact failure detection control and a motor drive control executed by the microcomputer 16A are described with reference to FIG. 6.

When the foot controller 10A is depressed by the user, the microcomputer 16A sets the connection error detection mode (S20) which detects the contact failure in the connector of the plug 11 and the jack 9. In the connection error detection mode, the microcomputer 16A switches the output state of the output port OP1 to a Hi impedance and outputs an "H" level (+5 V) to the output port OP2 (S21). Then, the microcomputer 16A loads the voltage data of a voltage dividing point T via the analog signal input port AP (S22).

Here the voltage of the voltage dividing point T is described in detail. In the connection error detection mode, the voltage +5V outputted to the output port OP2 is applied to the dividing point T via the resistance R2, however, the resistance value of the resistance R2 is 200 Ω therefore, the voltage decline of the resistance R2 is not very high. Therefore, the Zenner diode is conducted in the reverse direction and the Cascade voltage equals the Zenner voltage, which is 3.9 V. Consequently, because of the operation of the Zenner diode 14, the resistance R3 and the variable resistor VR connected in parallel with the Zenner diode is bypassed. That is, the voltage E of the voltage dividing point T is not affected by the resistance value of the resistance R3 and the variable resistor VR. Therefore, the voltage E can be arrived by the following formula, in which Ra refers to the contact resistance generated in between the first power line L1 and the second power line L3 and Rb refers to the contact resistance generated in between the first earth line L2 and the second earth line L4.

$$E=(5V-3.9V)\times\{(Ra+Rb)/(R2+Ra+Rb)\}+3.9V$$

According to this formula, for example, in case the contact state of the connector between the plug 11 and the jack 9 is good and the Rb is small enough to be ignored, the voltage E equals the Zenner voltage of the Zenner diode, which is 3.9 V. On the other hand, in case the connector between the plug 11 and the jack is in the contact failure state and for example 100 Ω of contact resistances Ra and Rb are generated respectively, the voltage E marginally exceeds the Zenner voltage of the Zenner diode to amount to approximately 4.45 V. That is, a threshold voltage is set based on the Zenner voltage of the Zenner diode 14 and by comparing the threshold voltage and the voltage E, the contact state of the connector between the plug 11 and the jack 9 can be judged. In the second embodiment, the threshold voltage is set to 4V.

The microcomputer 16A compares the loaded voltage data (voltage E) of the voltage dividing point T and the threshold voltage (4 V) (S23) and if it is judged that the voltage of the voltage dividing point is less than 4V, that is, the contact state of the connector of the plug 11 and the jack 9 is good and is in a normal state, where there is hardly any contact resistance (S23: NO), the normal operation mode is set (S24). In the normal operation mode, the microcomputer 16A outputs the "H" level (+5 V) to the output port OP1 and switches the output state of the output port OP2 to Hi impedance (S25). Then the microcomputer 16A loads the voltage data of voltage dividing point T via the analog signal input port AP (S26). At this point, because the Cascade voltage of the Zenner diode 14 becomes less than the Zenner voltage (3.9 V) via the voltage decline of the resistance R1, the voltage of the voltage dividing point T equals the resistance value of the variable resistor VR, that is, the voltage corresponding to the amount of depression of the foot controller 10A by the user. Then the microcomputer 16A controls the drive of the sewing machine motor 18 in correspondence with the voltage data of voltage dividing point T (S27). That is, the rotation speed of the sewing machine motor 18 is controlled in correspondence with the amount of depression of the foot controller 10A. The microcomputer 16A repeats the above described process S25 to S27 until the sewing process is completed, that is, when the depression of the foot controller 10A is released.

On the other hand, in the above described S23, when it is judged by the microcomputer 16A that the voltage (voltage E) of the voltage dividing point AT is 4 V or more (S23: Yes), the error process is started (S28) as described in the first embodiment. Next, the interruption control is described with reference to FIG. 7. The microcomputer 16A as in the first embodiment, executes the control of the interruption shown in FIG. 7 every time an interval interruption is made. In FIG. 7, in S20A to S24A and S28A, the process S20 to S24 and S28 shown in FIG. 6 is executed. That is, the microcomputer 16A when the interval interruption is made during the execution of the sewing process, sets the connection error detection mode (S20A) and the contact state of the connector between the plug 11 and jack 9 is judged (S20A to S23A). Then, in case contact failure is not detected (S23A: No), the normal operation mode is set (S24A) and the control is returned to the sewing process. On the other hand, in case the contact failure is detected (S23A: Yes), error processing is executed (S28A).

As described above, according to the second embodiment, in the normal operation mode, the resistance value of resistance R1 is set to 4.7 KΩ so that the Cascade voltage of the Zenner diode 14 becomes less than the Zenner voltage (3.9 V) and in the connection error detection mode, the resistance value of the resistance R2 is set to 200 Ω so that the Cascade voltage of the Zenner diode 14 equals the Zenner voltage. The microcomputer 16A is arranged so that in the connection error detection mode the voltage of the voltage dividing point T in the second power line L3 can be detected by outputting +5 V from the output port OP2 connected to the resistance R2. Therefore, the contact failure status of the connector can be reliably detected in correspondence with the status of increase of the contact resistance Ra and Rb in the connector of the plug 11 and the jack 9. Also, the above described configuration can be realized with a simple circuit arrangement.

Also, the microcomputer 16A compares the voltage (voltage E) of the voltage dividing point T, with the threshold voltage set based on the Zenner voltage of the Zenner diode 14 to judge the contact failure state of the connector, therefore, the judgment can be easily made as in the first embodiment and moreover, improve the accuracy of the judgment.

Furthermore, because the microcomputer 16A switches between the connection error detection mode and the normal operation mode, contact failures can be reliably detected in connection error detection mode as in the first embodiment and the drive control of the sewing machine motor can be reliably performed in the normal operation mode. Yet, furthermore, because the connection error detection mode and the normal operation mode are switched in predetermined intervals, contact failures can be immediately detected even in cases, in which the contact failures occur during the sewing work.

The present invention is not limited to the above described embodiments and can be transformed or expanded for example, as follows.

Figure 3:
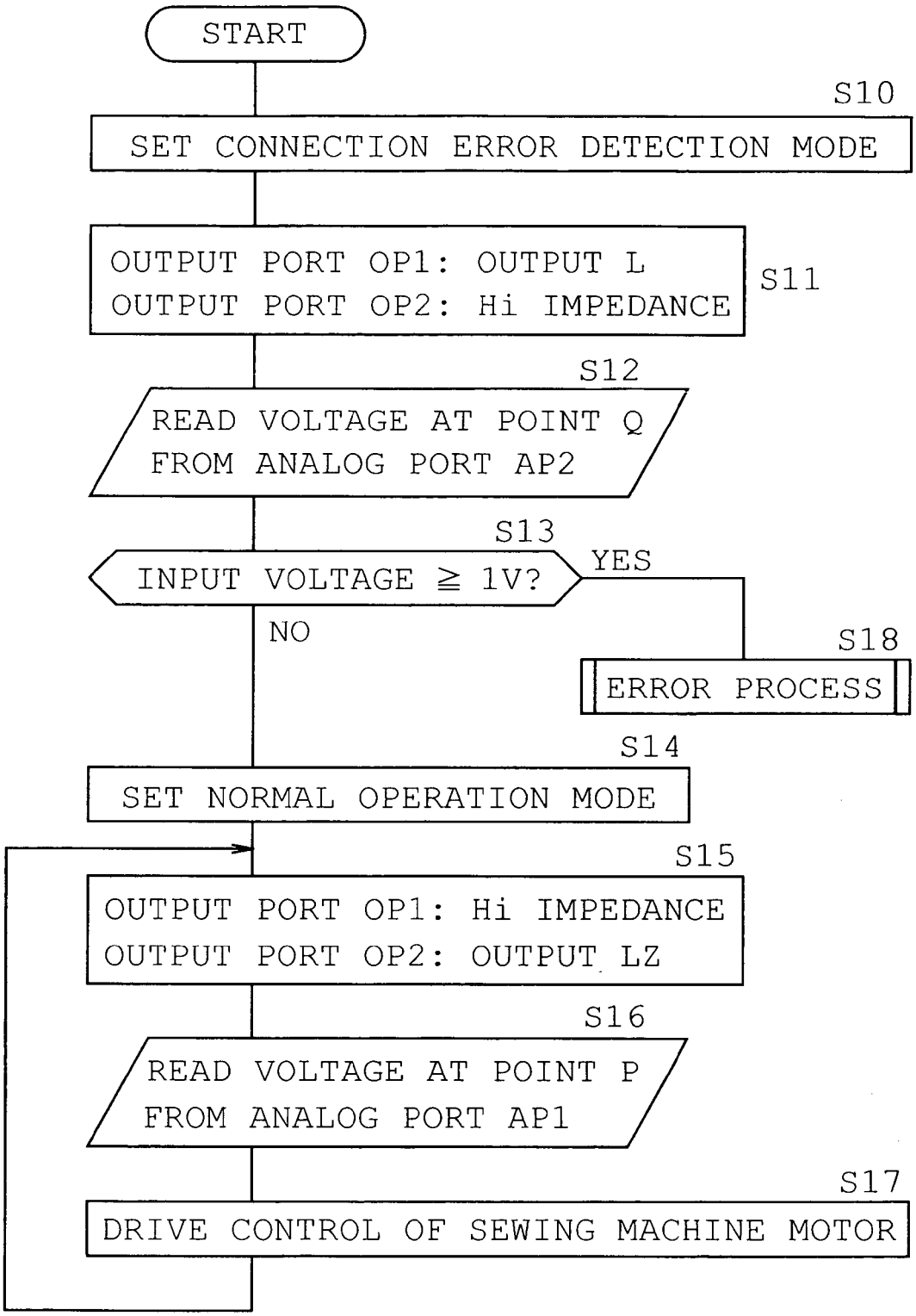
FIG. 3 is a foot controller connection error detection and motor drive control flow chart.
Figure 4:
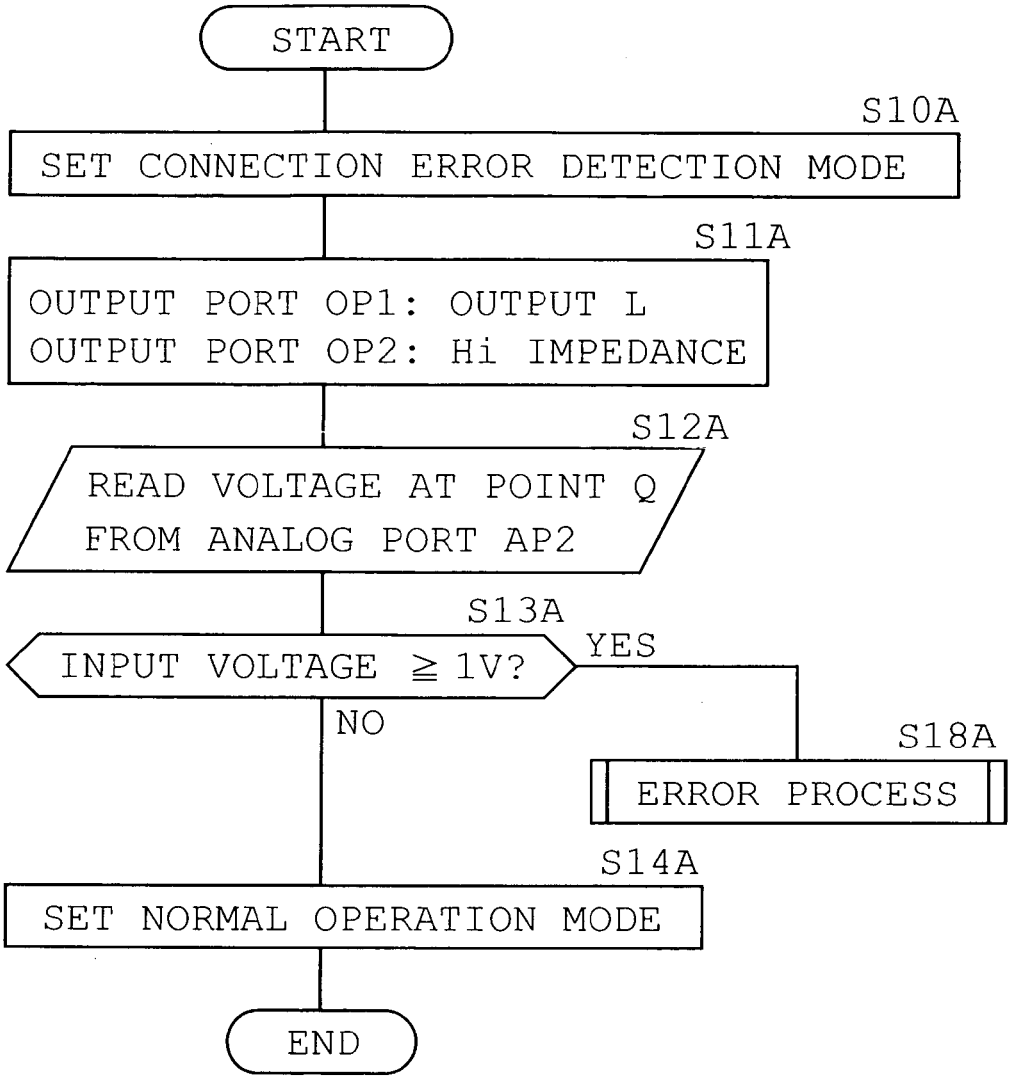
FIG. 4 is a flow chart of an interruption control.
Figure 6:
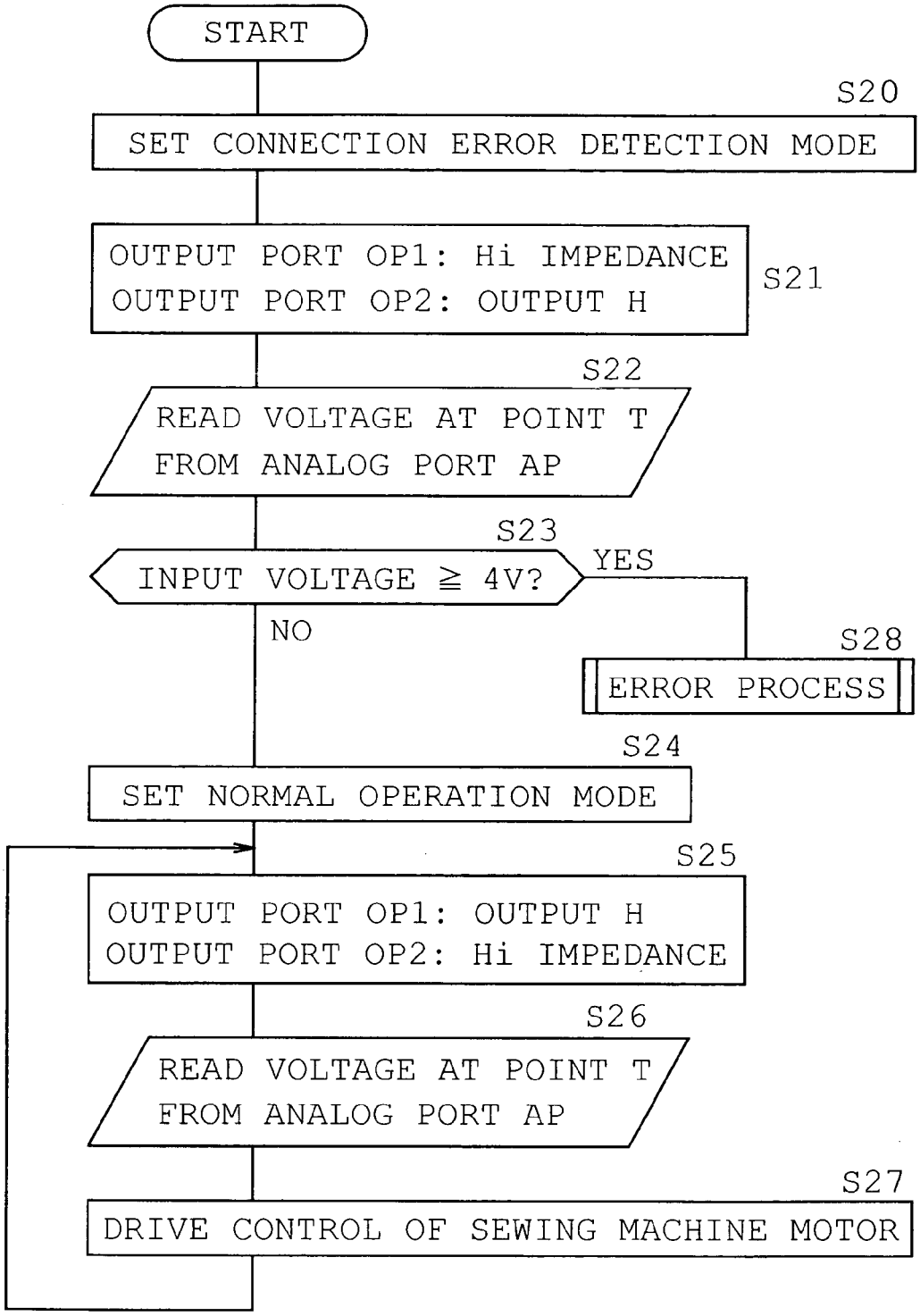
FIG. 6 corresponds to FIG. 3 concerning the second embodiment.
Figure 7:
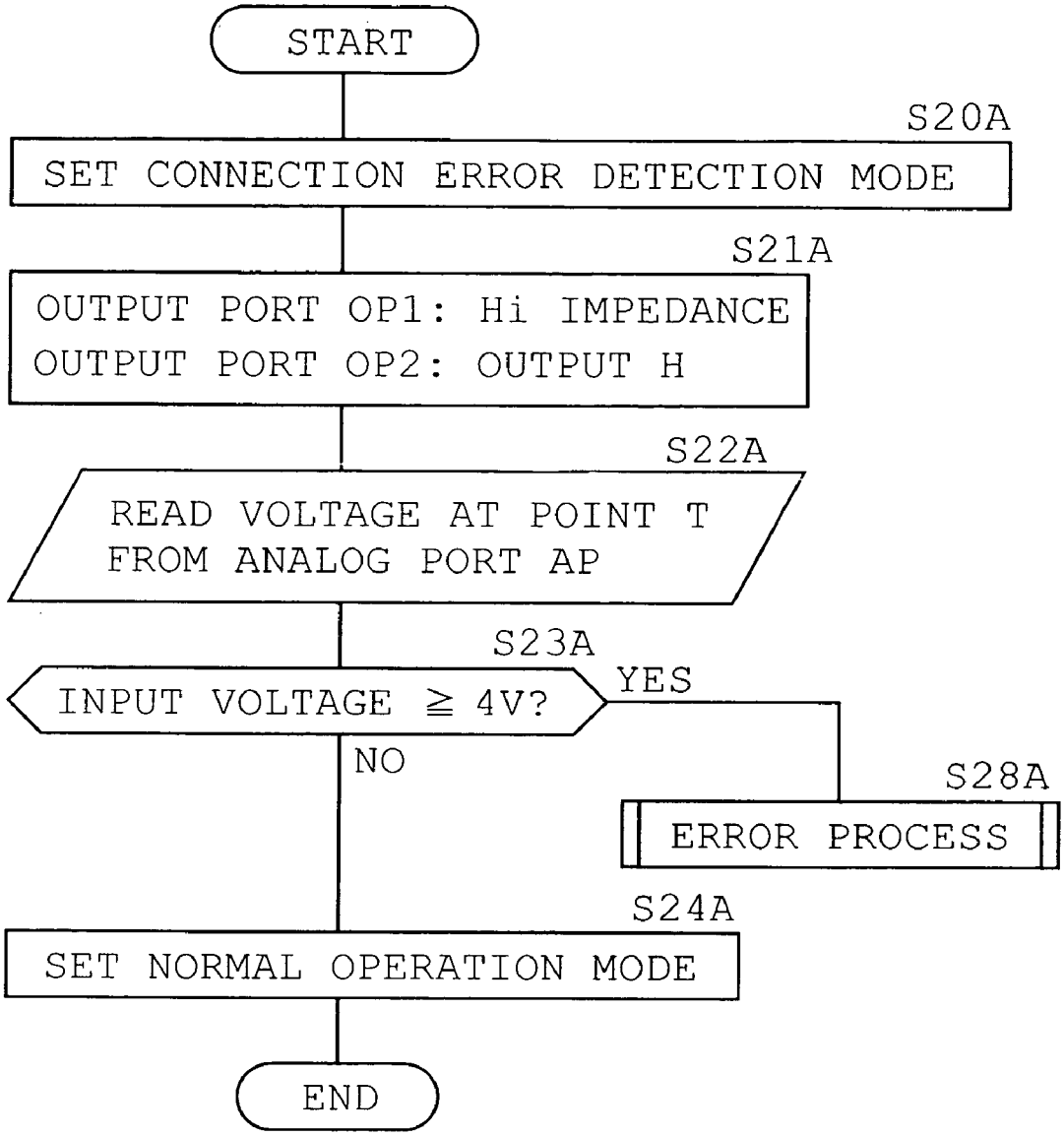
FIG. 7 corresponds to FIG. 4 concerning the second embodiment.
Figure 8:
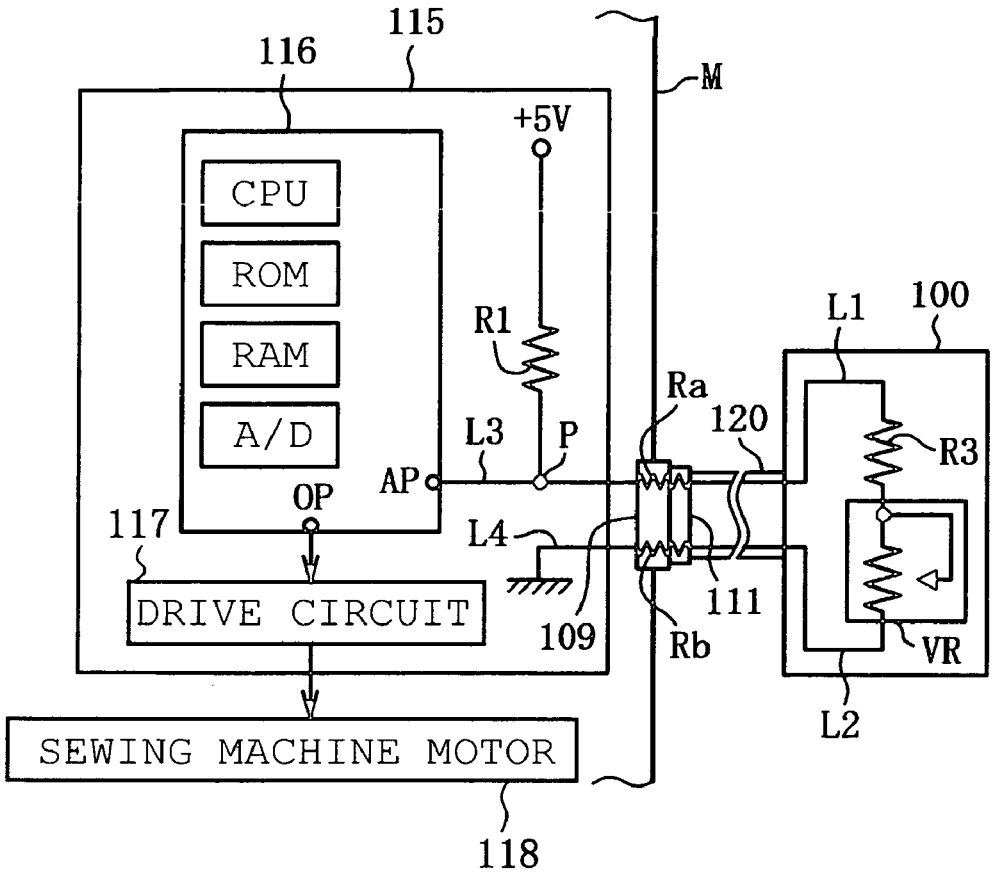
FIG. 8 corresponds to FIG. 2 concerning the prior art.

1) In the contact failure detection control and motor drive control of the foot controller indicated in S13 and S23 of FIG. 3 and FIG. 6, the threshold voltage can be changed accordingly based on temperature changes and characteristics of the diode 13 provided on the foot controller 10 and Zenner diode 14 provided on the foot controller 10A.

Figure 2:
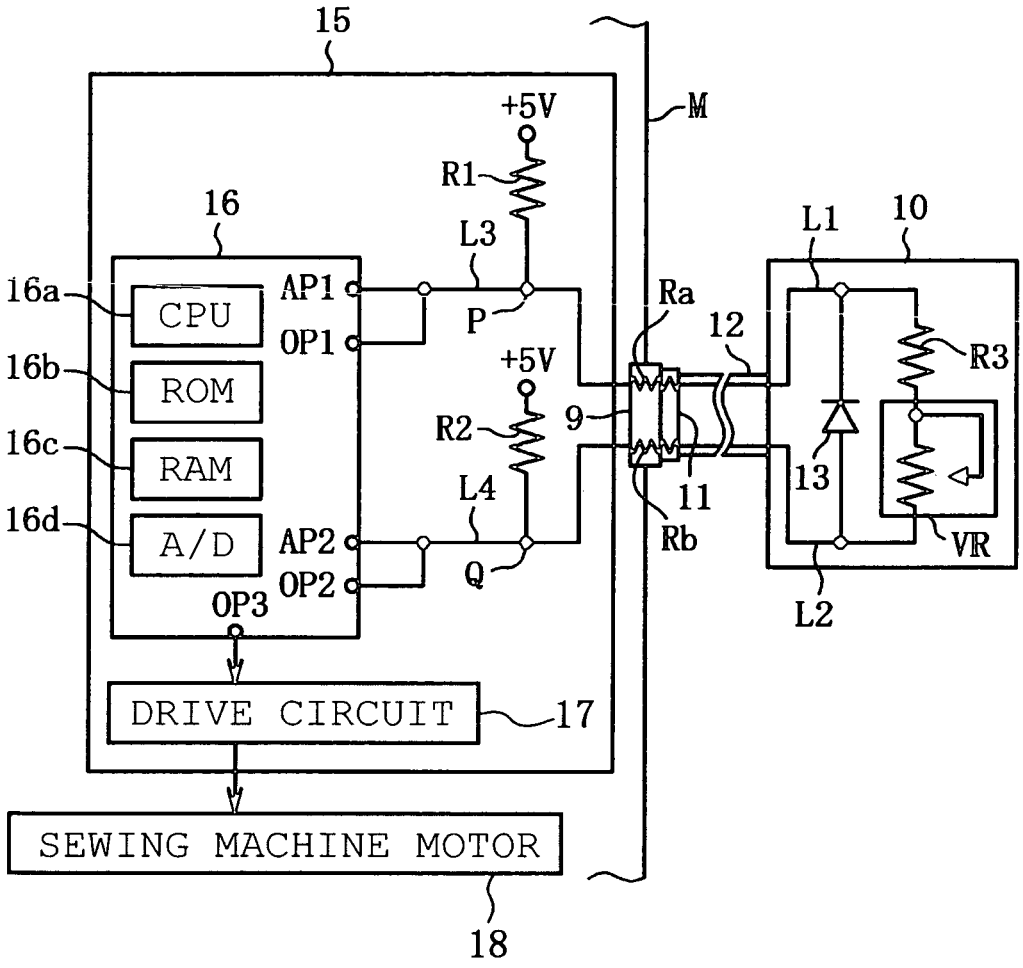
FIG. 2 is a sewing machine motor speed control circuit and contact failure detection circuit diagram.

2) The resistance value applied to the resistance R1 to R3 and the variable resistor VR for the sewing machine motor speed control circuit and contact failure detection control circuit shown in FIGS. 2 and 5 are merely examples, therefore, the resistance value can be changed accordingly depending on the types and sizes of the plug 11 and the jack 9 and the conditions of use including the impedance of the circuit configuration.

3) The start/stop switch provided on the foot controller 10 and 10A can be omitted and the drive of the sewing machine motor 18 can be started when the voltage data loaded via the analog signal input ports AP1, AP2 and AP reach the prescribed value or higher.

4) In the foot controller contact failure detection control and the motor drive control shown in FIGS. 3 and 6, the contact failure detection control (S10 to S13 and S20 to S23) and the motor drive control (S15 to S17 and S25 to S27) can be executed alternately.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

What is claimed is:

1. A foot controller connection error detection device of a sewing machine comprising:

a foot controller to output a start/stop instruction and a rotation speed instruction to a control unit to control a sewing machine motor;

a plug to disconnectably connect the foot controller to the control unit; and a contact failure detecting unit to detect a contact failure in a connector between the plug and the control unit.

2. The foot controller connection error detection device according to claim 1, wherein the contact failure detecting unit comprising a diode or a Zenner diode is connected in parallel with a variable resistor provided in the foot controller, in which a resistance value changes in correspondence with an amount of depression.

3. A foot controller contact failure detection device of a sewing machine comprising:

a foot controller to output a start/stop instruction and rotation speed instruct to a control unit to control a sewing machine motor;

a plug to disconnectably connect the foot controller to the control unit having a microcomputer;

a variable resistor connected in between a power line and an earth line inside the foot controller, in which a resistance value changes in correspondence with an amount of depression of the foot controller;

a diode connected in between the power line and the earth line in a reverse direction to a power applying direction and connected in parallel with the variable resistor; and a constant voltage applier to apply constant voltage to the earth line via a resistance having a resistance value smaller than the resistance value of electricity paths including the variable resistor and the microcomputer is arranged so that a scale of potential between the power line and the earth line can be set so that the contact failure of the connector in between the plug and the control unit is detected based on the voltage of the earth line set such that the voltage applied by the constant voltage applier becomes a forward voltage to the diode.

4. The foot controller connection error detection device according to claim 3, in which the microcomputer judges the contact failure state of the connector by comparing the voltage of an earth line with a threshold voltage which is set based on a forward voltage (Vf) of the diode.

5. The foot controller connection error detection device according to claim 3, in which the power line is connected to a first output port and a first analog signal port of the microcomputer, and the earth line is connected to a second output port and a second analog signal input port, wherein, the microcomputer switches between a connection error detection mode, which outputs a zero voltage from the first output port to the power line and reads a voltage level via a second analog signal input port and a normal operation mode, which outputs the zero voltage from the second output port to the earth line and reads the voltage level via the first analog signal input port.

6. The foot controller contact failure detection device according to claim 4, in which the power line is connected to the first output port and the first analog signal port of the microcomputer;

and the microcomputer switches between the connection error detection mode, which outputs the zero voltage from the first output port to the power line and reads the voltage level via the second analog signal input port and the normal operation mode, which outputs the zero voltage from the second output port to the earth line and reads the voltage level via the first analog signal input port.

7. A foot controller connection error detection device of a sewing machine comprising:

a foot controller to output a start/stop instruction and rotation speed instruction to a control unit to control a sewing machine motor;

a plug to disconnectably connect the foot controller to the control unit having a microcomputer;

a variable resistor connected in between a power line and an earth line inside the foot controller, in which the resistance value changes in correspondence with the amount of depression of the foot controller;

a diode connected in between the power line and the earth line in a reverse direction to a power applying direction and connected in parallel with the variable resistor;

wherein the power line is connected to a first output port and a second output port of the microcomputer; and the microcomputer switches between a normal operation mode to apply a constant voltage to the power line from the first output port via a first resistance having a predetermined resistance value, and a connection error detection mode to apply constant voltage to the power line from the second output port via a second resistance having a smaller resistance value than the resistance value of electricity paths including the variable resistor, in which the connection error detection mode detects the contact failure in a connector of the plug based on the voltage of the connection point of the second resistance and the power line.

8. The foot controller connection error detection device according to claim 7, in which the microcomputer judges the contact failure state of the connector by comparing the voltage of the power line with a threshold voltage which is set based on a Zenner voltage of a Zenner diode.

9. The foot controller connection error detection device according to claim 5, in which the microcomputer repeatedly executes the switch between the normal operation mode and the connection error detection mode not only at a start of the sewing process but also during a sewing process.

10. The foot controller connection error detection device according to claim 6, in which the microcomputer repeatedly executes the switch between the normal operation mode and the connection error detection mode not only at the start of the sewing process but also during the sewing process.

11. The foot controller contact failure detection device according to claim 7, in which the microcomputer repeatedly executes the switch between the normal operation mode and the connection error detection mode not only at the start of the sewing process but also during the sewing process.

12. The foot controller contact failure detection device according to claim 8, in which the microcomputer repeatedly executes the switch between the normal operation mode and the connection error detection mode not only at the start of the sewing process but also during the sewing process.

* * * * *